US005127205A

United States Patent [19]

Eidson

[11] Patent Number: 5,127,205

[45] Date of Patent: Jul. 7, 1992

[54] SUPPORT CLIP FOR ROOFING PANELS AND ASSOCIATED SYSTEM

[76] Inventor: Carson J. Eidson, Rte. 7, Box 506, Jonesborough, Tenn. 37659

[21] Appl. No.: 609,176

[22] Filed: Nov. 5, 1990

[51] Int. Cl.[5] ..... E04D 1/00

[52] U.S. Cl. ..... 52/520; 52/528; 52/529; 52/545; 52/478; 52/732

[58] Field of Search ..... 52/520, 528, 732, 478, 52/544, 588, 529, 545

[56] References Cited

U.S. PATENT DOCUMENTS

| | | | |
|---|---|---|---|
| 1,882,105 | 10/1932 | Wender . | |
| 2,150,217 | 3/1939 | Gettelman | 108/1 |
| 3,210,896 | 10/1965 | Detman | 52/22 |
| 3,998,019 | 12/1976 | Reinwall, Jr. | 52/478 |
| 4,193,247 | 3/1980 | Heckelsberg | 52/713 |
| 4,361,998 | 12/1982 | Ellison et al. | 52/520 |
| 4,429,508 | 2/1984 | Sizemore | 52/713 |
| 4,495,743 | 1/1985 | Ellison et al. | 52/478 |
| 4,514,952 | 5/1985 | Johansson | 52/713 |
| 4,570,404 | 2/1986 | Knudson | 52/520 |
| 4,575,983 | 3/1986 | Lott, Jr. et al. | 52/544 |
| 4,651,493 | 3/1987 | Carey | 52/710 |
| 4,656,794 | 4/1987 | Thevenin et al. | 52/22 |
| 4,796,403 | 1/1989 | Fulton et al. | 52/713 |
| 4,807,414 | 2/1989 | Krause | 52/478 |

*Primary Examiner*—David A. Scherbel
*Assistant Examiner*—Khen Nguyen
*Attorney, Agent, or Firm*—Luedeka, Hodges, Neely & Graham

[57] ABSTRACT

A clip for slidably attaching a ribbed metal roof panel to a structural support underlying the roof panel includes a base member and a slide member which are interfitted in a manner which permits the slide member to shift relative to the base member. The base and slide members include interfitted sections which are U-shaped in cross section, and the interfitted sections include a cut-out and detent which cooperate to limit the amount of relative shifting between the base and slide members. A particular embodiment of the clip is well-suited for use when mounting a ribbed panel in spaced relationship above a ribbed panel of an existing roof structure.

16 Claims, 4 Drawing Sheets

SUPPORT CLIP FOR ROOFING PANELS AND ASSOCIATED SYSTEM

BACKGROUND OF THE INVENTION

This invention relates generally to rib-type metal roofs and relates more particularly to means for securing rib-type metal roofing panels to underlying structural members.

In a metal roof structure commonly referred to as a "rib" type, the edges of adjacent panels are placed in overlapping relationship, and the overlapped panels are secured to the structural members underlying the panels by appropriate securing means, such as self-tappinq sheet metal screws. Commonly, each panel of a rib-type metal roof is elongate in form and has a plurality of parallel ribs formed therein which run lengthwise of the panel. These panels, being metal, are known to experience dimensional changes, i.e., expansion and contraction, due to temperature variations to which the panels are exposed. In order to alleviate stresses and strains spawned by the expansion and contraction of the panels, devices or clips may be interposed between the panels of the roof and the underlying structural members for accommodating longitudinal dimensional changes in the panels. One such device is shown and described in U.S. Pat. 4,429,508.

It is an object of the present invention to provide a new and improved device of the aforedescribed class which accommodates longitudinal expansion and contraction of a rib-type roofing panel supported atop an underlying structural member.

Another object of the present invention is to provide such a device which is uncomplicated in construction and effective in operation.

Still another object of the present invention is to provide such a device which is well-suited for supporting a rib-type roofing panel above an existing rib-type roof.

A further object of the present invention is to provide a roofing system which incorporates such a device.

SUMMARY OF THE INVENTION

This invention resides in a clip for slidably attaching a ribbed roof panel to a structural support underlying the roof panel.

The clip comprises a base member having a lower section for securement of the base member in a stationary relationship with a structural support underlying the roof panel and an upstanding section extending upwardly from the lower section. The upstanding section is U-shaped in cross section having one leg which is joined to the lower section and which extends upwardly therefrom to the bend of the U and another leg which extends downwardly from the bend of the U to a location spaced above the lower section.

The clip also includes a slide member having an upper section for attachment to a roof panel positioned upon the clip and has a depending section depending downwardly from the upper section. The depending portion is U-shaped in cross section having one leg which is joined to the upper section and which extends downwardly therefrom to the bend of the U and another leg which extends upwardly from the bend of the U to a location spaced below the upper section. The upstanding section of the base member and the depending section of the slide are interfitted with one another so that the another leg of the U of the depending section is slidably received by the U of the upstanding section, and the another leg of the U of the upstanding section is slidably received by the U of the depending section so that the slide member is permitted to shift relative to the base member to accommodate movement of the panel relative to the underlying support.

In a particular aspect of the invention, the clip is positionable upon a first ribbed roof panel of an existing roof structure for slidably supporting a second ribbed roof panel above the first ribbed roof panel. Each of the ribbed roof panels has a plurality of parallel ribs which run the length of the panel, and each rib includes sloped sidewalls and a pan section which extends between the sidewalls. The sidewalls and pan section of each rib collectively provide a downwardly-opening recess which runs along the underside of its panel. In this embodiment, the clip includes a base member having a lower section for attachment of the clip in a stationary relationship to the first roof panel adjacent a preselected rib of the first panel and an upstanding section extending generally upwardly from the lower section. The clip also includes a slide member for attachment of the clip to the second roof panel. The slide member is configured to fit within the downwardly-opening recess provided by one rib of the second roof panel for attachment of the slide member to the pan section of the one rib. The clip further includes means for connecting the slide member to the upstanding section of the base member so that the slide member is supported on the upstanding section of the base member generally vertically above the selected rib of the first panel for movement of the slide member on the base member in a direction generally parallel to the length of the ribs of the first roof panel to accommodate movement of the second roof panel relative to the first roof panel with the ribs of the second roof panel in general vertical registry with the ribs of the first roof panel.

DETAILED DESCRIPTION OF THE ILLUSTRATED EMBODIMENTS

Figure 1:
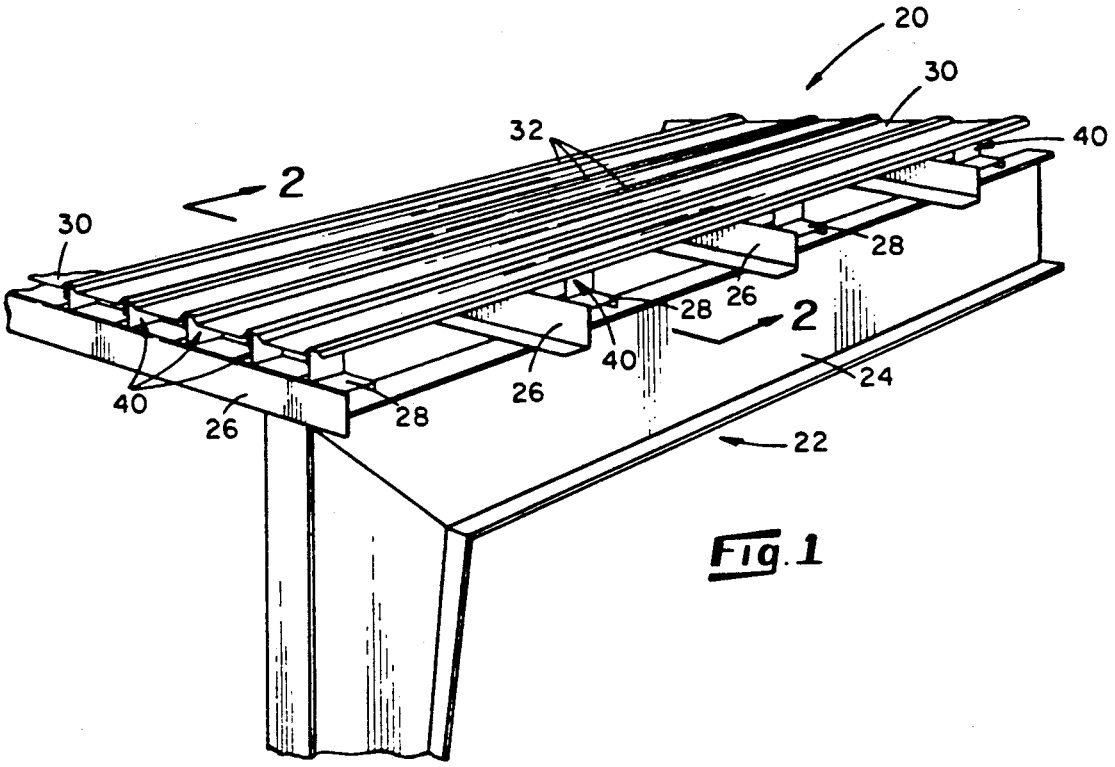
FIG. 1 is a fragmentary perspective view of a roof structure within which an embodiment of a clip is incorporated.

Turning now to the drawings in greater detail and considering first FIG. 1, there is illustrated a rib-type roof structure 20 supported atop a structural frame 22 of a metal building. The frame 22 includes rafters in the form of I-beams 24 which extend generally upwardly at an angle from the eave of the building to the peak of the roof. Supported by the I-beams 24 are roof purlins 26 which are disposed in spaced parallel relation with one another and which extend horizontally across the top of the I-beams 24. Each roof purlin 26 is in the form of a steel channel having a bottom portion which is attached to the I-beams 24 across which the purlins 26 extend and having a top portion defining a flat upper surface 28.

Figure 2:
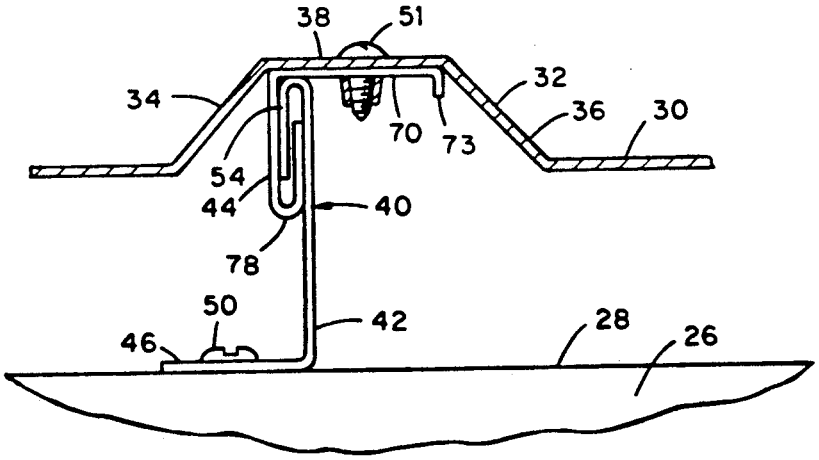
FIG. 2 is a fragmentary cross-sectional view taken along line 2—2 of FIG. 1.

The roof structure 20 includes a plurality of rectangular panels 30 arranged in overlapping and side-by-side relationship across the purlins 26. Each panel 30 is elongate in form with two relatively short ends, two relatively lengthy sides extending between the ends and a plurality of parallel ribs 32 extending longitudinally of the panel 30 between the ends thereof. As best shown in FIG. 2, each rib 32 is formed with two opposite sloped sidewalls 34, 36 and a flat pan section 38 which extends between the sidewalls 34, 36 adjacent the top thereof. When the panels 30 are installed upon a roof, at least one rib 32 of one panel 30 is placed so as to matingly overlap at least one rib 32 of an adjacent panel 30.

Figure 3:
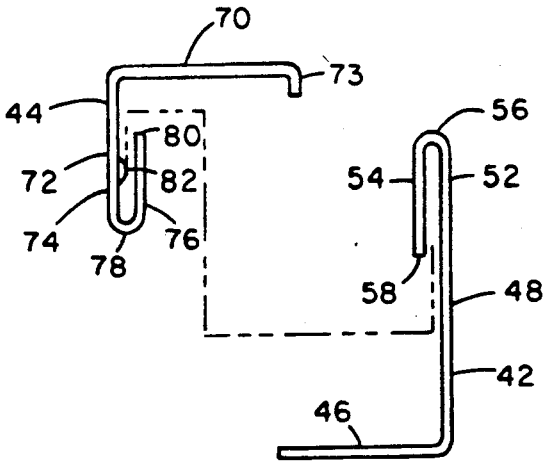
FIG. 3 is an end view of the clip illustrated in FIG. 2, shown exploded.

The ribbed panels 30 are supported atop the purlins 26 by a plurality of clips 40 interposed between the panels 30 and the purlins 26. As best shown in FIG. 3, each clip 40 includes a base member 42 which is attachable to an underlying purlin 26 and a slide member 44 which is attachable to a roof panel 30. As is apparent herein, the base and slide members 42, 44 are interfitted in a manner which permits the slide member 44 to shift longitudinally with respect to the base member 42. When installed in the roof structure 20 beneath the panels 30, the clips 40 permit the roof panels 30 to shift longitudinally with respect to the purlins 26 and thereby relieve stresses and strains within the structure 20 which are a consequence of the expansion or contraction of the panels 30 due to variations in the atmospheric temperature to which the panels 30 are exposed.

Figure 4:
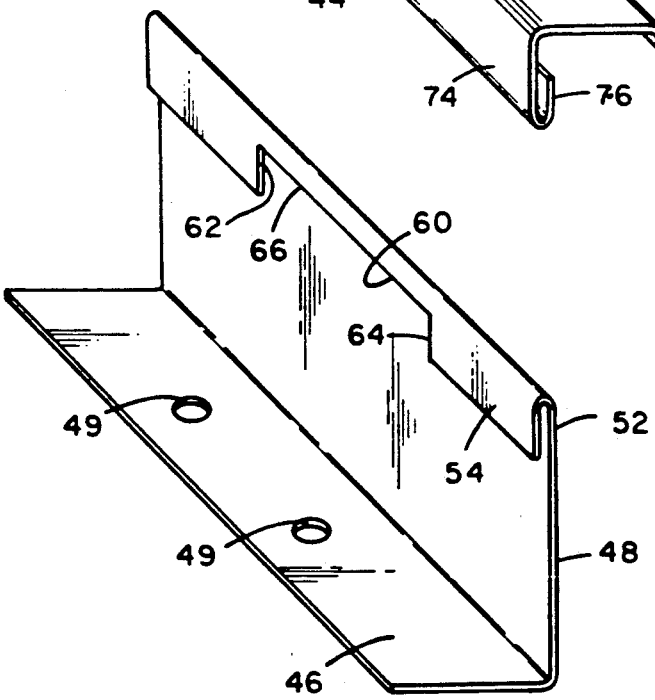
FIG. 4 is a perspective view of one component of the FIG. 2 clip as seen generally from the left in FIG. 3.

With reference to FIGS. 2–4, the base member 42 includes an elongated lower section 46 which is attachable to an underlying purlin 26 and an upstanding section 48 which extends upwardly from the lower section 46. The lower section 46 is flat so as to stably overlie the top surface 28 of the underlying purlin 26 and includes a pair of apertures 49 through which screws 50 (only one shown in FIG. 2) may be inserted for securement of the base member 42 in a stationary relationship with the underlying purlin 26.

As best shown in FIG. 3, the upstanding section 48 includes an upper portion which is generally U-shaped in cross-section having two legs 52, 54 joined at a bend 56 and arranged in such a relationship with the lower section 46 so that its U opens downwardly toward the lower section 46. One leg 52 is joined directly to the lower section 46 along one side thereof, and the other leg 54 depends downwardly from the bend 56 so that the free end, indicated 58, of the leg 54 is spaced an appreciable distance above the lower section 46. As shown in FIG. 4, each leg 52 or 54 extends the full length of the lower section 46. One leg 54 of the upstanding section 48 includes a cutout 60 which opens downwardly as shown in FIG. 4. In the depicted section 48, the cutout 60 is centered between the ends of the section 48 and has two opposing parallel sides 62, 64 and a linear edge 66 extending between the sides 62, 64.

Figure 5:
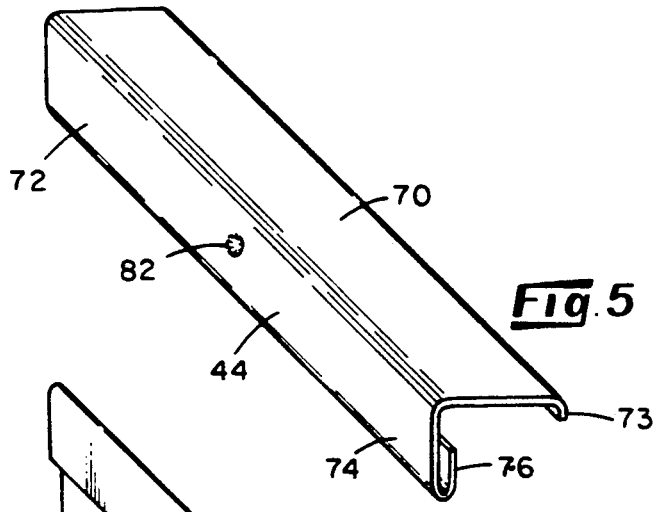
FIG. 5 is a perspective view of the other component of the FIG. 2 clip as seen generally from the left in FIG. 3.

With reference to FIGS. 2, 3 and 5, the slide member 44 includes an elongated upper section 70 which is attachable to a roof panel 30 positioned upon the clip 40 and a depending section 72 which depends downwardly from the upper section 70 along the length thereof. The upper section 70 is relatively narrow as measured between its side edges for acceptance between the sidewalls 34, 36 of the panel rib 32 and has a flat upper surface for flatly engaging the underside of the flat pan 38. In the depicted clip 40, the upper section 70 is sized to be nestingly received between the sidewalls 34, 36 when engaging the flat pan 38, as shown in FIG. 2, and is secured to the flat pan 38 with self-tapping screws 51 (only one shown in FIG. 2). For rigidifying the upper section 70, a downwardly-depending lip 73 is formed along one side edge of the upper section 70 opposite the depending section 72.

As best viewed in FIG. 3, the depending section 72 includes a portion which is generally U-shaped in cross section having two legs 74, 76 joined at a bend 78 and arranged in such a relationship with the upper section 70 so that its U opens upwardly toward the upper section 70. One leg 74 is joined directly to the upper section 70 along one side thereof, and the other leg 76 extends upwardly from the bend 78 so that the free end, indicated 80, of the leg 76 is spaced from the upper section 70. As shown in FIG. 5, each leg 74 or 76 extends the full length of the upper section 70.

The Us of each upstanding section 48 or depending section 72 are proportioned to slidably accept a corresponding leg 54 or 76 of the other section 72 or 48. Accordingly, the opening provided by each U is slightly greater in width than the thickness of the leg 54 or 76 which the U is adapted to accept. When assembling the base member 42 and the slide member 44, the legs 54 and 76 are inserted endwise, i.e., longitudinally, into the opening provided by the U of the other section 72 or 48. With the slide member 44 interfitted with the base member 52 in the manner illustrated in FIG. 2, the leg 54 is captured between the upper section 70 and the bend 78 of the slide member 44 to prevent the base and slide members 42, 44 from coming apart by moving the Us of the sections 72, 48 directly apart, or vertically apart as viewed in FIG. 2.

Once the base and sliding members 42, 44 are interfitted in the manner illustrated in FIG. 2, a detent 82 (FIG. 5) is formed in one leg 74 of the depending section 72 so as to protrude into the cutout 60 of the leg 54 of the upstanding section 52. The detent 82 is located substantially midway along the length of the slide member 44 and cooperates with the cutout 60 to limit the longitudinal movement of the slide member 44 relative to the base member 42. More specifically, if the slide member 44 is moved endwise relative to the base member 42 in one longitudinal direction, the detent 82 abuts one side 62 or 64 of the cutout 60 to prevent additional endwise movement of the slide member 44 in that one direction. Similarly, if the slide member 44 is moved endwise relative to the base member 42 in the other longitudinal direction, the detent 82 abuts the other side 64 or 62 of the cutout 60 to prevent additional endwise movement of the slide member 44 in that other direction.

It follows from the foregoing that with the base member 42 fixedly secured to a purlin 26 and the slide member 44 fixedly secured to a roof panel 30 in the manner illustrated in FIG. 2, the roof panel 30 is permitted to shift longitudinally with respect to the purlin 26 to accommodate a lengthwise dimensional change in the panel 40. Therefore, the clips 30 reduce the likelihood that the roof structure 20 will be exposed to stresses and strains which may otherwise result from lengthwise expansion or contraction of the panel 30.

Figure 6:
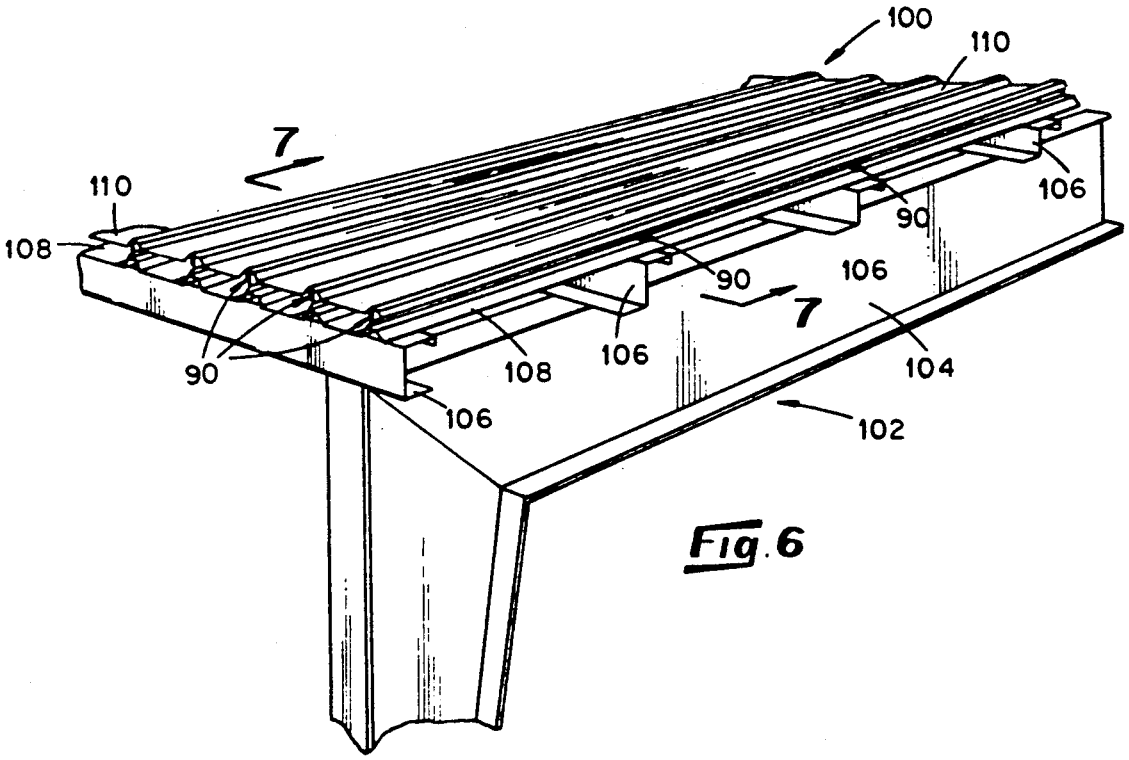
FIG. 6 is a fragmentary perspective view of a roof structure within which another embodiment of a clip is incorporated.
Figure 7:
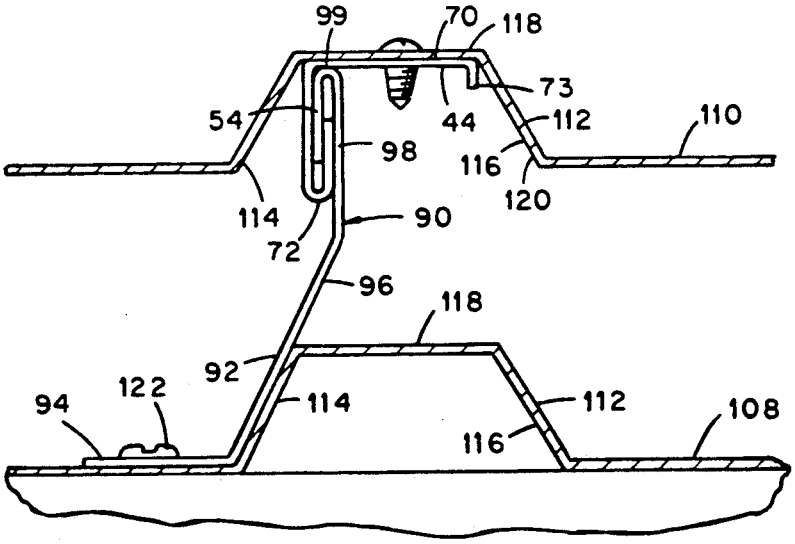
FIG. 7 is a fragmentary cross-sectional view taken along line 7—7 of FIG. 6.
Figure 8:
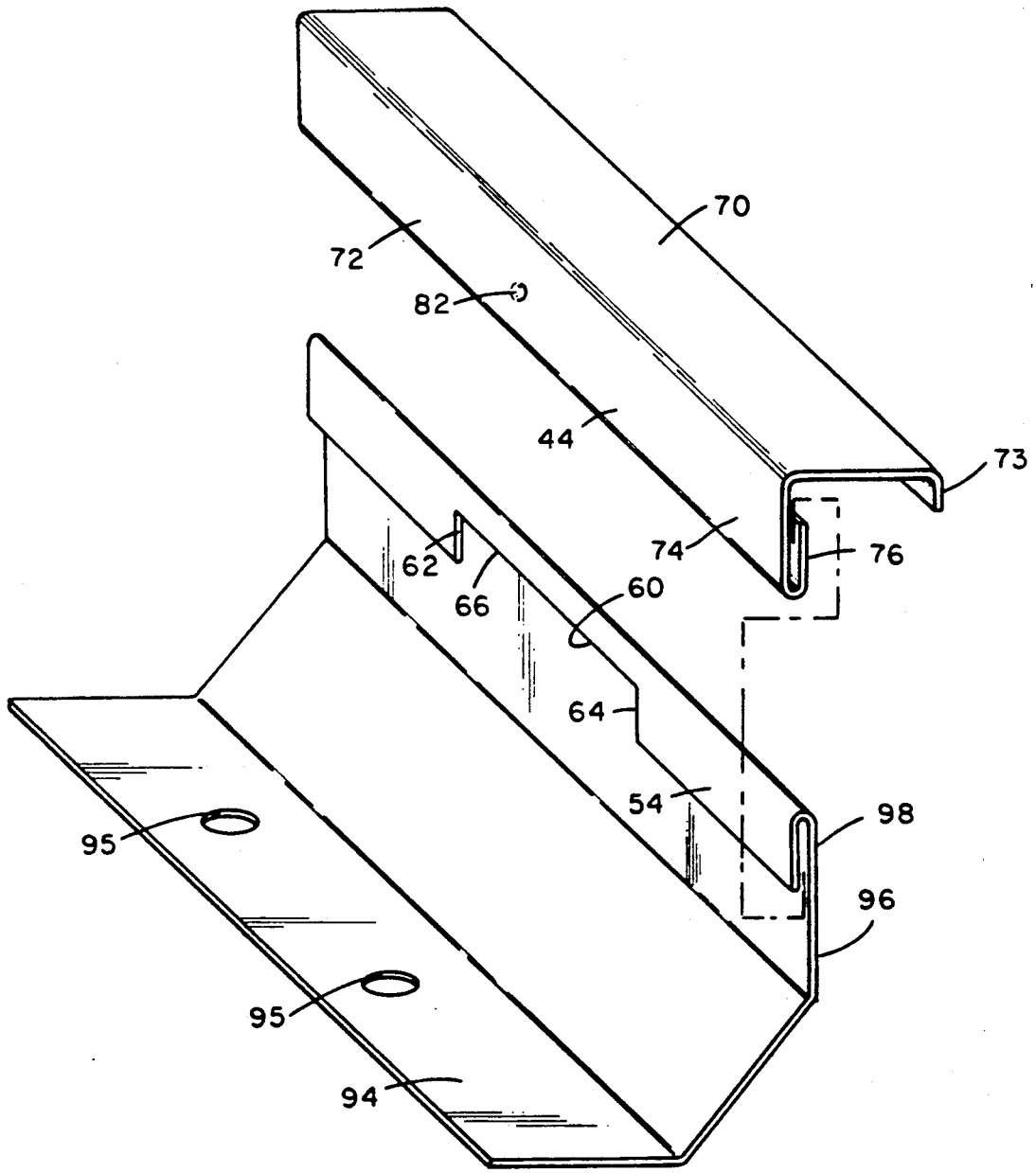
FIG. 8 is a perspective view of the clip of FIG. 7, shown exploded.

With reference to FIGS. 6–8, there is illustrated an alternative embodiment, indicated 90, of a clip embodying features of the present invention shown utilized in a rib-type roof structure 100. The roof structure 100 is supported atop a structural frame 102 including I-beam rafters 104 and a plurality of purlins 106 disposed in spaced parallel relation across the I-beams 104. Included in the structure 100 is a first, or lower, layer of panels 108 and a second, or upper layer of panels 110 disposed above the first layer of panels 108. The panels 108 and 110 may be identical in construction and each may include a plurality of ribs 112 extending longitudinally of the panel. As best shown in FIG. 7, each rib 112 may be formed with two opposing sloped sidewalls 114, 116 and a flat pan section 118 which extends between the sidewalls 114, 116 adjacent the top thereof. Collectively, the sidewalls 114, 116 and flat pan section 118 provide a downwardly opening recess 120 which runs along the underside of its panel 108 or 110. Each panel 108 or 110 partially overlaps an adjacent panel 108 or 110 in its corresponding layer so that at least one rib 112 of one panel 108 or 110 matingly overlaps at least one rib 112 of an adjacent panel 108 or 110 to provide an overall uniform arrangement of continuous, parallel evenly spaced-apart ribs extending across the width of the structure 100.

In the depicted roof structure 100, a plurality of clips 90 are disposed between the lower layer of panels 108 and the upper layer of panels 110 for supporting the panels 108 and 110 in a spaced parallel relationship. Each clip 90 includes a base member 92 and a slide member 44 which is interfitted with the base member 92 in a manner which permits the slide member 44 to shift longitudinally with respect to the base member 92. In this embodiment, the slide member 44 of each clip 90 of FIGS. 6–8 is identical to that of the slide member 44 of the clip 40 of FIGS. 1–5 and, accordingly, the slide member components bear the same reference numerals. The upper section 70 of the slide member 44 is thus sized to be nestingly received by the downwardly-opening recess 116 provided by the rib 112 of a panel 110, as shown in FIG. 7.

The base member 92 includes an elongated lower section 94 and an elongated upstanding section 96 extending generally upwardly from the lower section 94. The lower section 94 is flat for stably overlying the horizontal span between adjacent ribs 112 of the lower panels 108, preferably above a purlin 106, and includes a pair of apertures 95 for securement of the base member 92 to the underlying purlin 106 with self-threading screws 122 (only one shown in FIG. 7) extending through the lower panels 108. The upstanding section 96 includes a U-shaped upper portion having two legs 98, 54 joined at a bend 99. One leg 54 of the clip 90 of FIGS. 6–8 is identical to the leg 54 of the clip 40 of FIGS. 1–5, and accordingly, its components and cut-out bear the same reference numerals.

It is a feature of the clip 90 that the leg 98 of its base member 92 includes a lower portion which is shaped in conformance with the shape of a sidewall 112 or 114 of a rib 112 of a panel 108 so that when the base member 92 is secured atop a panel 108 as shown in FIG. 7, its upstanding section 96 engagably lies against the sidewall 34 or 36. In the depicted structure 100, each sidewall 112, 114 is sloped at about a fifty degree angle with respect to the horizontal span between adjacent rib 112, and the lower portion of the leg 98 of the upstanding section 96 is sloped accordingly. Therefore, an appreciable amount of the area of the sidewall 112 or 114 engages the sloped portion of the leg 98 when the base member 92 is secured adjacent the rib 112 to assist in supporting the section 96 in its upstanding condition.

It is also a feature of each clip 90 that the ribs 112 of the lower panels 108 and the upper panels 110 may be disposed in approximate vertical registry. To this end, the upper section 44 of each clip 90 is disposed in such a positional relationship relative to the base member 92 so that when the lower section 94 of the base member 92 is secured to the roof panel 108 with the lower portion of the leg 98 disposed against the rib sidewall 114 of the lower panel 108, and with the upper section 70 accepted by the downwardly-opening recess 120 provided by the rib 112 of the panel 110, the ribs 112 of the lower and upper panels 108 and 110 are in approximate vertical registry.

With the ribs 112 of the lower and upper panels 108, 110 in vertical registry, the slide member 44 of each clip 90 is disposed generally vertically above the rib 112 of the lower panel 108 and the base member 92 of each clip 90 is disposed closely to one side of the rib 112 of the lower panel 108. This arrangement transmits the weight of the upper panel 110 to the lower panel 108 to locations adjacent the ribs 112 of the panel 108 and maintains a relatively uniform spacing, i.e. air gap, between the upper and lower panels 108, 110. This air gap provides an insulative layer between the upper and lower panel layers and is advantageous in this respect. Also, the space that is provided readily accommodates a layer of insulation which need not be significantly compressed to retain a desired effective thickness, even at the locations where the panels are joined to the understructure. In addition, the clips 90 accommodate an efficient installation of a new roof system including an upper layer of panels 110 atop an existing roof system including a layer of panels 108 to avoid the cost and inconvenience associated with the removal of the existing roof prior to installation of the new roof system.

An advantage associated with the illustrated embodiments of the invention is that the clips 40 and 90 may be disposed in alternating rows facing in opposite directions along adjacent purlins 106 or along and above adjacent purlins underlying an existing set of panels 108. The use of such alternatingly directed rows of clips 40 and 90 provides an exceedingly stable arrangement against sidewise movement of the panels 30 or 110 relative to the underlying structure (as opposed to the permitted longitudinal movement) so that collapse of the panels 30 or 110 caused by a force directed generally parallel to the plane of the roof is substantially prevented.

A further advantage of the clips 40 and 90 of the illustrated embodiments is that the supported roof panel is attached to the clips along the top of the ribs. No apertures need to be made in the roof panels at the relatively low, water collecting portion of the panels in the horizontal span between adjacent ribs. Thus, water accumulation and consequent leakage at the point of attachment between the roof panels and the clips 40 and 90 is virtually eliminated.

The structure of the clips 40 and 90 of the illustrated embodiments is also exceedingly simple so that manufacturing costs are kept low. Also, no special skill or training is required for installation of the clips which can be completed in an expedient manner with standard tools and equipment. Overall, the clips of the invention contribute to a roof structure that combines functional improvements and significant cost reductions for a material advance in the art.

It will be understood that numerous modifications and substitutions can be had to the aforedescribed embodiment without departing from the spirit of the invention. Accordingly, the aforedescribed embodiments are intended for the purpose of illustration and not as limitation.

We claim:

1. A clip for slidably attaching a ribbed roof panel to a structural support underlying the roof panel comprising:

a base member having a lower section for securement of the base member in a stationary relationship with a structural support underlying the roof panel and an upstanding section being U-shaped in cross section so that the U shape of the cross section has a bend and two legs which are joined to the bend of the U shape, one leg of the U shape of the base member being joined directly to the lower section and extending upwardly therefrom to the bend of the U shape and the other leg of the U shape of the base member extending downwardly from the bend of the U shape to a location spaced above the lower section;

a slide member having an upper section for attachment to a roof panel placed upon the clip and having a depending section depending downwardly from the upper section, the depending section being U-shaped in cross section so that the U shape of the cross section has a bend and two legs which are joined to the bend of the U shape, a first leg of the U shape of the slide member being joined directly to the upper section and extending downwardly therefrom to the bend of the U shape of the slide member and a second leg extending upwardly from the bend of the U shape to a location spaced below the upper section, the depending section of the slide member and the upstanding section of the base member being interfitted with the another so that said second leg of the U shape of the depending section is slidably received by the U shape of the upstanding section and said other leg of the U shape of the upstanding section is slidably received by the U shape of the depending section so that the slide member is permitted to shift relative to the base member to accommodate movement of the panel relative to the underlying support; and the upper section of the slide member includes a portion overlying the bend of the U shape of the upstanding section of the base member so that the slide member is supported on the bend of the U shape of the upstanding section of the base member so that the bend of the base member acts as a runner along which the slide member is shiftable lengthwise of the base as aforesaid.

2. The clip as defined in claim 1 wherein one of said other leg of the upstanding section and said second leg of the depending section includes a cutout and the adjacent one of said one leg of the upstanding section and said first leg of the depending section includes means defining a detent accepted by said cutout for limiting the shifting movement of the slide member relative to the base member.

3. The clip as defined in claim 1 wherein said other leg of the U shape of the upstanding section includes a downwardly-opening cutout having two spaced-apart sides, and said first leg of said depending section includes a detent which protrudes into so as to be accepted by the cutout of the upstanding section so that longitudinal movement of the slide member relative to the base member is limited by the engagement of the detent against the sides of the cutout.

4. The clip as defined in claim 1 wherein the ribs on the roof panel define upwardly projecting elongate recesses on the bottom surface of the panel and wherein said upper section is adapted to fit within said recesses so that sidewise movement of the panel upon said slide member is limited by engagement of said upper section against the panel with the recess.

5. The clip as defined in claim 1 wherein the legs of each of said lower section and said upper section are substantially planar in shape and arranged generally parallel to one another.

6. The clip as defined in claim 1 wherein each of said upstanding and depending sections is elongated in shape and its U-shaped cross section extends generally along its entire length, and the direction in which the upstanding section is permitted to shift relative to the base member is parallel to the longitudinal axis of at least one of the upstanding and depending sections.

7. A clip for slidably attaching a ribbed metal roof panel to a structural support underlying the roof panel comprising:

a base member having an elongate lower section for securement of the base member in a stationary relationship with a structural support underlying the roof panel and an upstanding section extending upwardly from the lower section, said upstanding section being U-shaped in cross section along its length so that the U shape of the cross section has a bend and two legs which are joined to the bend of the U shape, one leg of the U shape of the base member being joined directly to the lower section and extending upwardly therefrom to the bend of its U shape and the other leg of the U shape of the base member extending downwardly from the bend of its U shape to a location spaced above the lower section;

a slide member having an elongate upper section for attachment to a roof panel positionable upon the clip and having a depending section depending downwardly from the upper section, said upper section having an upper surface which generally corresponds in shape to the underside of the roof panel so that substantially the entire upper surface of the upper section engages the roof panel when the roof panel is positioned upon the clip, the depending portion being U-shaped in cross section along its length so that the U shape of the cross section has a bend and two legs which are joined to the bend of the U shape, a first leg of the U shape of the slide member being joined directly to the upper section and extending downwardly therefrom to the bend of its U shape and the second leg of the U shape of the slide member extending downwardly from the bend of its U shape to a location spaced below the upper section, the depending section and the upstanding section being interfitted with one another so that said second leg of the U shape of the depending section is slidably received by the U shape of the upstanding section and said other leg of the U shape of the upstanding section is slidably received by the U shape of the depending section so that the slide member is permitted to shift longitudinally relative to the base member to accommodate a dimensional change in the panel relative to the underlying support;

the upper section of the slide member including a portion overlying the bend of the U shape of the upstanding section of the base member so that said other leg of the upstanding section is captured between said upper section and the bend of the U shape of the depending section; and the upper section of the slide member includes a portion overlying the bend of the U shape of the upstanding section of the base member so that the slide member is supported on the bend of the U shape of the upstanding section of the base member and so that the weight borne by the base member through the slide member during use of the clip is concentrated over a line of points extending along the length of the base member so that the bend of the base member acts as a runner along which the slide member is permitted to shift as aforesaid.

8. The clip as defined in claim 7 wherein one of said other leg of the upstanding section and said second leg of the depending section includes a cutout and the adjacent one of said one leg of the upstanding section and said first leg of the depending section includes means defining a detent accepted by sad cutout for limiting the longitudinal movement of the slide member relative to the base member.

9. The clip as defined in claim 7 wherein said other leg of the U shape of the upstanding section includes a downwardly-opening cutout having two spaced-apart sides, and said first leg of said depending section includes a detent which protrudes into so as to be accepted by the cutout of the upstanding section so that longitudinal movement of the slide member relative to the base member is limited by the cooperation between the sides of the cutout and the detent.

10. A clip positionable upon a first ribbed roof panel of an existing roof structure for supporting a second ribbed roof panel above the first ribbed roof panel wherein each of the ribbed roof panels has a plurality of parallel upwardly projecting ribs which run the length of the panels, each rib including sloped sidewalls and a pan section which extends between the sidewalls, an edge of the second ribbed roof panel being fixedly secured to an edge of an adjacent panel of like construction positioned alongside the second roof panel, the sidewalls and pan section of each rib collectively providing a downwardly-opening recess which runs along the underside of its panel, said support clip comprising:

a base member having a lower section for attachment of the clip in a stationary relationship to the first roof panel adjacent a selected one of its ribs and an upstanding section extending upwardly from the lower section;

a slide member for attachment of the clip to the second roof panel, said slide member disposed within the downwardly-opening recess of an adjacent rib of the second roof panel for attachment of the slide member to the pan section of said adjacent rib; and means for connecting said slide member to said upstanding section of said base member for movement of said slide member on said base member to accommodate movement of the second roof panel and said adjacent panel fixedly secured thereto relative to the first roof panel so that when the clip is utilized with a plurality of like clips for supporting a plurality of second ribbed roof panels fixedly secured to one another upon a plurality of first ribbed roof panels or an existing roof structure, the clips permit at least a portion of the overlying plurality of second ribbed roof panels to shift as a unit relative to the underlying plurality of first ribbed roof panels as said slide members are permitted to shift relative to their corresponding base members.

11. The clip as defined in claim 10 wherein the base member and slide member are each elongate in form and are arranged so that their longitudinal axes are generally parallel to one another so that when the lower section of the base member is secured to the first roof panel, the longitudinal axis of the lower section is generally parallel to the run of the ribs of the first roof panel and the slide member is accepted by the one rib of the second roof panel with the longitudinal axis of the slide generally parallel to the run of the ribs of the second roof panel, whereby the ribs of the first and second roof panels are generally parallel to one another.

12. The clip as defined in claim 10 wherein the upstanding section of the base member is U-shaped in cross section so that the U shape of the cross section has a bend and two legs which are joined to the bend of the U shape, one leg of the U shape of the base member being joined directly to the lower section and extending upwardly therefrom to the bend of the U shape and the other leg of the U shape of the base member extending downwardly from the bend of the U shape to a location spaced above the lower section;

said slide member having a depending section which is U-shaped in cross section so that the U shape of the cross section has a bend and two legs which are joined to the bend of the U shape, and an upper section for attachment to the second roof panel, the U shape of said depending section having a first leg which is joined directly to the upper section and extends downwardly therefrom to the bend of the U shape and a second leg which extends upwardly from the bend of the U shape to a location spaced below the upper section, and the depending section and the upstanding section are interfitted with one another so that said second leg of the U shape of the depending section is slidably received by the U shape of the upstanding section and said other leg of the U of the upstanding section is slidably received by the U shape of the depending section so that the slide member is permitted to shift relative to the base member as aforesaid.

13. In combination:

an existing roof structure having at least one ribbed roof panel having ribs which run the length thereof, said one ribbed roof panel being a first roof panel;

an additional roof structure having a second ribbed roof panel having parallel ribs which run the length thereof and a third ribbed roof panel positioned adjacent said second roof panel so that the second and third roof panels are fixed to one another along the edges thereof; and a plurality of clips for slidably supporting the second roof panel of the additional roof structure in a spaced relationship above the first roof panel, each of said slips including a) a base member having a lower section for securement of the base member in a stationary relationship with the first roof panel adjacent one of its ribs and an upstanding section extending upwardly from the lower section; and b) a slide member having an upper section for attachment to a roof panel placed upon the clip and having a depending section depending downwardly from the upper section, said depending section being interfitted with the upstanding section in a manner which permits the slide member to shift relative to the base member to accommodate a dimensional change in the panel relative to the first roof panel;

the upstanding section of the base member including a first portion which is shaped in conformance with the shape of a sidewall of a preselected rib of the first panel so that when the base member is secured to the first roof panel adjacent the preselected rib, said first portion engagably lies against a sidewall of the preselected rib;

the upper section of the slide member being sized for acceptance by the downwardly-opening recess provided by one rib of the second roof panel for attachment of the upper section to the pan section of said one rib;

the upper section being disposed in such a positional relationship relative to the base member so that when the lower section of the base member is secured to the first roof panel with its first portion engagably lying against a sidewall of a preselected rib of the first panel and the upper section is accepted by the downwardly-opening recess provided by one rib of the second roof panel, the preselected rib of the first roof panel and the one rib of the second roof panel are in vertical registry at said clip and so that the second and third panels are permitted to shift as a unit relative to the existing roof structure as the slide members of the clips are permitted to shift relative to the base members of the clips.

14. The combination of claim 13 wherein each of the lower and upper sections of said clip is elongate in form and arranged so that the longitudinal axes of the lower and upper sections are parallel to one another so that when the lower section of the base member is secured to the first roof panel so that the longitudinal axis of the lower section is parallel to the run of the ribs of the first roof panel and the upper section is accepted by the one rib of the second roof panel so that the longitudinal axis of the upper section is parallel to the run of the ribs of the second roof panel, the ribs of the first and second roof panels are parallel to one another.

15. The combination of claim 13 wherein the upstanding section of each base member is U-shaped in cross section so that the U shape of the cross section has a bend and two legs which are joined to the bend of the U shape, one leg of the U shape of the base member being joined directly to the lower section and extending upwardly therefrom to the bend of the U shape and the other leg of the U shape of the base member extending downwardly from the bend of the U shape to a location spaced above the lower section;

said slide member having a depending section which is U-shaped in cross section so that the U shape of the cross section has a bend and two legs which are joined to the bend of the U shape, and an upper section for attachment to the second roof panel, the U shape of said depending section having a first leg which is joined directly to the upper section and extends downwardly therefrom to the bend of the U shape and a second leg which extends upwardly from the bend of the U shape to a location spaced below the upper section, and the depending section and the upstanding section are interfitted with one another so that said second leg of the U shape of the depending section is slidably received by the U shape of the upstanding section and said other leg of the U shape of the upstanding section is slidably received by the U shape of the depending section so that the slide member is permitted to shift relative to the base member as aforesaid.

16. The combination of claim 15 wherein said other leg of the U shape of the upstanding section includes a downwardly-opening cutout having two spaced-apart sides, and said first leg of said depending section includes a detent which protrudes into so as to be accepted by the cutout of the upstanding section so that longitudinal movement of the slide member relative to the base member is limited by the cooperation between the sides of the cutout and the detent.

* * * * *

UNITED STATES PATENT AND TRADEMARK OFFICE

CERTIFICATE OF CORRECTION

PATENT NO. : 5,127,205

DATED : July 7, 1992

INVENTOR(S) : Carson J. Eidson

It is certified that error appears in the above-identified patent and that said Letters Patent is hereby corrected as shown below:

Column 1, line 14, "self-tappinq" should be --self-tapping--.

Column 7, line 40, "the" should be --one--.

Column 10, line 63, "slips" should be --clips--.

Signed and Sealed this

Seventh Day of September, 1993

Bruce Lehman

*Attest:*

BRUCE LEHMAN

*Attesting Officer*

*Commissioner of Patents and Trademarks*